US011788456B2

(12) United States Patent
Rocchini et al.

(10) Patent No.: US 11,788,456 B2
(45) Date of Patent: Oct. 17, 2023

(54) ENGINE ASSEMBLY PROVIDED WITH AN INTERNAL COMBUSTION ENGINE COOLED BY A PHASE CHANGE MATERIAL

(71) Applicant: FPT INDUSTRIAL S.P.A., Turin (IT)

(72) Inventors: Marco Rocchini, Turin (IT); Clino D'Epiro, Alpignano (IT)

(73) Assignee: FPT INDUSTRIAL S.P.A., Turin (IT)

( * ) Notice: Subject to any disclaimer, the term of this patent is extended or adjusted under 35 U.S.C. 154(b) by 0 days.

(21) Appl. No.: 17/780,727

(22) PCT Filed: Nov. 24, 2020

(86) PCT No.: PCT/IB2020/061095

§ 371 (c)(1),
(2) Date: May 27, 2022

(87) PCT Pub. No.: WO2021/105880

PCT Pub. Date: Jun. 3, 2021

(65) Prior Publication Data

US 2022/0412246 A1 Dec. 29, 2022

(30) Foreign Application Priority Data

Nov. 29, 2019 (IT) ..... 102019000022560

(51) Int. Cl.
*F01K 3/00* (2006.01)
*F01P 3/02* (2006.01)
(Continued)

(52) U.S. Cl.
CPC ..... *F01P 3/02* (2013.01); *F01K 3/00* (2013.01); *F01N 5/02* (2013.01); *F02B 33/02* (2013.01);
(Continued)

(58) Field of Classification Search
CPC ..... F01K 3/00; F01K 25/08; F01K 23/065; F01K 25/065; F01N 5/02; F02B 33/02;
(Continued)

(56) References Cited

U.S. PATENT DOCUMENTS 4,224,798 A 9/1980 Brinkerhoff
4,733,536 A 3/1988 DiBella
(Continued)

FOREIGN PATENT DOCUMENTS

WO 2010/067080 A1 6/2010
WO WO-2016120598 A1 * 8/2016 ..... F02B 29/0443

OTHER PUBLICATIONS

International Search Report and Written Opinion in PCT Application No. PCT/IB2020/061095, dated Jan. 25, 2021.
(Continued)

*Primary Examiner* — Hung Q Nguyen
(74) *Attorney, Agent, or Firm* — Leason Ellis LLP

(57) ABSTRACT

An engine assembly is provided with a split-cycle internal combustion engine having a compression section and an expansion section and with a cooling circuit for circulating a heat-exchange fluid; said fluid has a boiling temperature such that at least a fraction of the fluid changes phase from liquid to vapour flowing through the expansion section of the engine, when the latter operates in steady conditions; the circuit comprises a turbine arranged downstream of the engine so as to receive vapour and produce mechanical energy from the expansion of the vapour.

14 Claims, 2 Drawing Sheets

(51) Int. Cl.

| | |
|---|---|
| ***F01N 5/02*** | (2006.01) |
| ***F02B 33/02*** | (2006.01) |
| ***F02G 5/00*** | (2006.01) |

(52) U.S. Cl.
CPC ..... *F02G 5/00* (2013.01); *F01P 2003/021* (2013.01); *F01P 2003/024* (2013.01)

(58) Field of Classification Search
CPC ..... F02B 33/22; F02G 5/00; F02G 2250/00; F01P 2003/021; F01P 2003/024; F01P 2003/001; F01P 2005/105; F01P 2070/04; F01P 3/22; F22B 1/18; Y02T 10/12
See application file for complete search history.

(56) References Cited

U.S. PATENT DOCUMENTS

| | | | | |
|---|---|---|---|---|
| 6,866,092 | B1 * | 3/2005 | Molivadas | F01L 3/12 165/47 |
| 2004/0255882 | A1 | 12/2004 | Branyon | |
| 2007/0221145 | A1 * | 9/2007 | Forner | F01N 5/02 123/41.01 |
| 2010/0156111 | A1 | 6/2010 | Pesce | |
| 2014/0230761 | A1 * | 8/2014 | Pilavdzic | F01P 3/2271 123/41.21 |

OTHER PUBLICATIONS

Morgan, Robert, Dong, Guangyu, Panesar, Angad, & Heikal, Morgan (Jul. 2016). A comparative study between a Rankine cycle and a novel intra-cycle based waste heat recovery concepts applied to an internal combustion engine. Applied Energy, 108-117. doi:101016/japenergy201604026.

* cited by examiner

ENGINE ASSEMBLY PROVIDED WITH AN INTERNAL COMBUSTION ENGINE COOLED BY A PHASE CHANGE MATERIAL

CROSS-REFERENCE TO RELATED APPLICATIONS

This patent application is a U.S. National Phase Application under 35 U.S.C. § 371 of International Patent Application No. PCT/IB2020/061095, filed on Nov. 24, 2020, which claims priority from Italian patent application no. 102019000022560 filed on Nov. 29, 2019, all of which are incorporated by reference, as if expressly set forth in their respective entireties herein.

TECHNICAL FIELD

The invention relates to an engine assembly provided with an internal combustion engine cooled by means of a heat-exchange fluid comprising a phase-change material. In particular, the invention is advantageously applied to the cooling of a split-cycle internal combustion engine.

KNOWN STATE OF THE ART

As it is known, split-cycle engines comprise at least one compression cylinder, which is dedicated to the compression of the oxidizing air, and at least one combustion cylinder or expansion cylinder, which communicates with the compression cylinder through one or more inlet valves so as to receive a charge of compressed air with every cycle, together with a fuel injection. The expansion cylinder is dedicated to the combustion of the air/fuel mixture, to the expansion of the burnt gases to generate mechanical energy and to the discharge of said gases, so that it basically acts like a two-stroke engine, which, in turn, operates the compression cylinder.

In order to improve the efficiency of the compression, the temperature increase and, hence, the work needed during the compression of the air should be limited. To this aim, for example, a liquid substance can be injected into the cylinder so that, during the compression of the air, this substance evaporates, absorbs heat thanks to the phase change and, hence, maintains the temperature of the air at the level of its own boiling temperature.

At the same time, the walls of the compression cylinder/s can be cooled through convection, to a temperature that is as low as possible, in order to remove heat and limit the air temperature increase.

On the other hand, the expansion cylinder needs to be maintained at temperatures that are suitable for its operation, but these temperatures are higher than the ones of the compression cylinder. For the compression cylinder, a traditional cooling system is generally used, with a cooling liquid circulating in the crankcase and in the head of the engine and generally consisting of a mixture of water and ethylene glycol.

In a traditional engine, all cylinders evidently have the same cooling needs, whereas in a split-cycle engine this condition does not apply.

Therefore, the known solutions described above need to be improved, in particular from the point of view of the overall thermodynamic efficiency, keeping the compression work low and exploiting in an ideal manner the residual heat that the heat-exchange fluid managed to remove from the engine.

The object of the invention is to provide an engine assembly, which fulfils the above-mentioned need in a simple and economic fashion.

SUMMARY OF THE INVENTION

According to the invention, there is provided an engine assembly as claimed in claim 1.

In particular, the engine assembly comprises a split-cycle internal combustion engine, which is cooled by means of a heat exchange fluid comprising at least one phase-change material suited to change phase from liquid to vapour while flowing in the cooling channels of the engine itself, under the temperature and pressure conditions chosen during the cooling channel designing phase.

BRIEF DESCRIPTION OF THE DRAWINGS

The invention will be best understood upon perusal of the following detailed description of two preferred embodiments, which are provided by way of non-limiting example, with reference to the accompanying drawings, wherein.

BEST MODE FOR CARRYING OUT THE INVENTION

Figure 1:
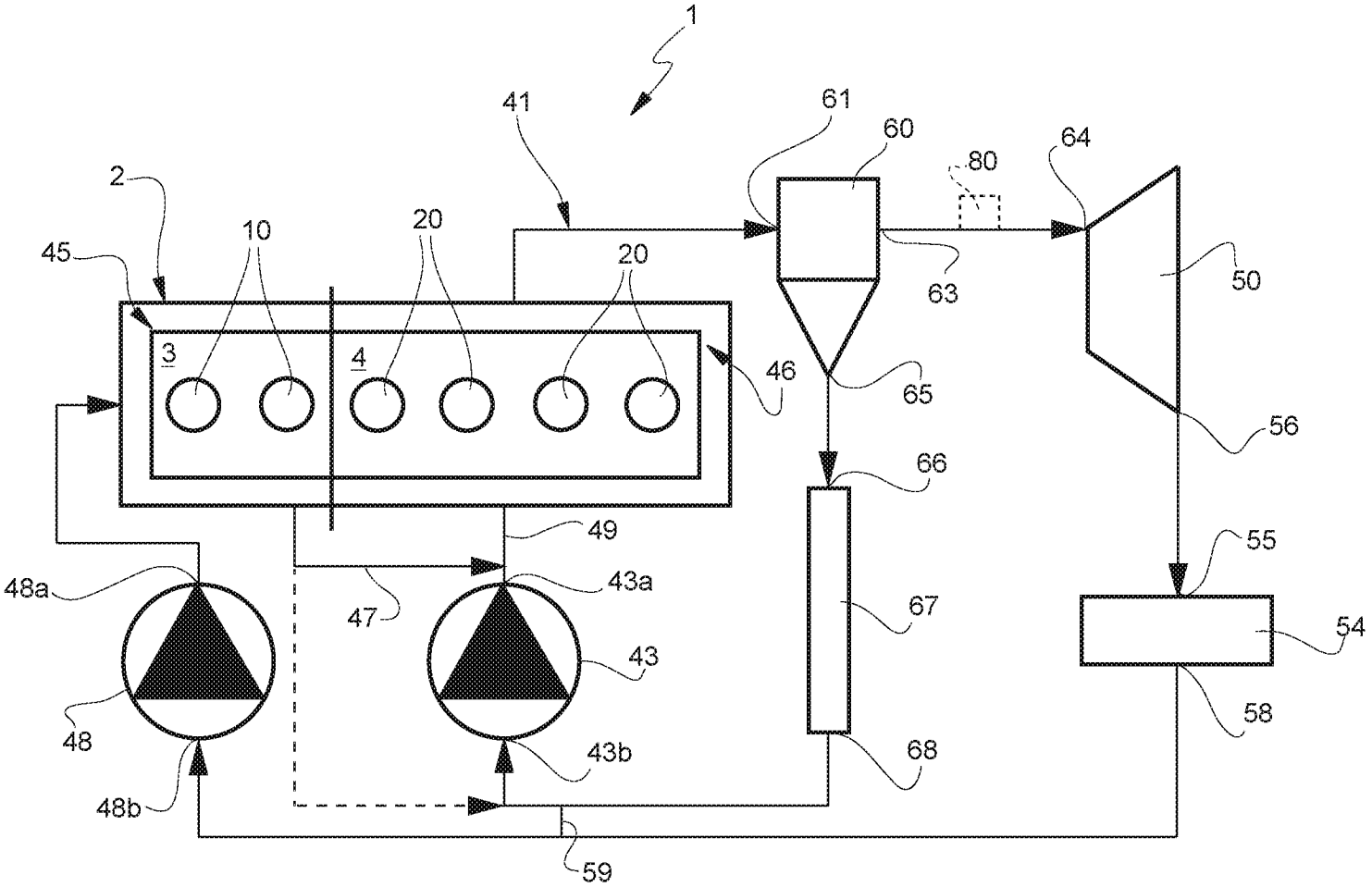
FIG. 1 is a diagram showing a first embodiment of the engine assembly according to the invention.

With reference to what is schematically shown in FIG. 1, reference number 1 indicates an engine assembly, in particular to drive a motor vehicle (nor show) or for an agricultural machinery.

The assembly 1 comprises an internal combustion engine 2, which, in particular, is defined as split-cycle engine.

The engine 2 consists of a compression section 3 and of an expansion section 4: the compression section 3 is dedicated to the compression of air, so that it basically defines a volumetric compressor; the expansion section 4 is designed to the receive the air compressed by the compression section 3 through at least one connection duct (not shown) and to receive a quantity of fuel from an injection system (not shown) and is dedicated to the combustion of the air/fuel mixture, to the expansion of the gases produced by the combustion and to the discharge of said gases, so that it basically acts like a two-stroke engine.

The compression section 3 comprises one or more compression cylinders 10. For example, there are two cylinders 10. Each cylinder 10 comprises a respective liner and a respective piston defining, between them, a compression chamber designed to receive an air flow, coming from the outside, in a direct or indirect manner (through a pre-compression stage which is not shown herein, for example). The piston is provided with a reciprocating motion so as to carry out, with every cycle, an intake stroke, during which air flows into the compression chamber through one or more intake valves, and a compression stroke, during which air is compressed and then flows out of the compression chamber through one or more delivery valves in the aforesaid connection duct. The pistons of the compression section 3 are preferably operated by a same driven shaft (nor shown), which is defined, in particular, by a crankshaft.

Similarly, the expansion section 4 comprises one or more expansion cylinders (or combustion cylinders) 20. For example, the cylinders 20 are twice the cylinders 10. Each cylinder 20 comprises a respective liner and a respective piston defining, between them, a combustion chamber designed to receive the air under pressure coming from the aforesaid connection duct, through one or more inlet valves, together with the fuel injected by the injection system. The piston makes a reciprocating motion having an expansion stroke, during which air and fuel flow into the combustion chamber and form a mixture, which is ignited (in a controlled manner or spontaneously) in order to then produce an expansion of the burnt gases and generate mechanical energy, and an exhaust stroke, during which the burnt gases are discharged through one or more outlet valves in an exhaust system, which is not shown and is provided with exhaust gas treatment devices.

The pistons of the cylinders 20 preferably operate a same driving shaft (not shown), which is defined, for example, by a crankshaft and operates, in turn, the driven shaft of the compression section 3 in a direct or indirect manner. In the example schematically shown herein, the cylinders 10 and 20 are aligned with one another and the shafts of the sections 3 and 4 are aligned with one another along the same rotation axis.

The engine 2 comprises a crankcase, which, for example, is shared by both sections 3 and 4. In other words, the crankcase comprises two distinct portions where the compression cylinders and the expansion cylinders are respectively arranged; alternatively, separate crankcases are provided for the sections 3 and 4. The engine 2 also comprises two distinct heads or two portions that are part of a same head and are associated with the sections 3 and 4, respectively.

The assembly 1 further comprises a cooling circuit 41, which conveys a heat-exchange fluid along one or more closed loops and comprises at least one pump 43. In particular, the circuit 41 comprises a portion 45, which extends through the compression section 3 (in the crankcase and/or in the respective head), a portion 46, which extends through the expansion section 4 (in the crankcase and/or in the respective head), and a portion 47, which extends on the outside of the components to be cooled in the engine 2 and connects an outlet of the portion 45 to an outlet of the portion 46, so that the sections 3 and 4 are cooled in series by at least part of the heat-exchange fluid.

Therefore, the inner cooling channels defining the portions 45 and 46 of the circuit 41 extend in the material of the crankcase (around the cylinders) and/or in the material of the head (around the ducts and valves feeding air to the cylinders and/or around the outlet ducts and valves that allow exhaust gases to be discharged from the cylinders 20).

The circuit 41 preferably comprises a further pump 48, which is distinct from the pump 43, so as to independently feed respective fractions of the heat-exchange fluid to the sections 3 and 4. In other words, the pump 43 has a delivery mouth 43*a* connected to portion 46 (in a direct manner or through a duct 49), whereas the pump 48 has a delivery mouth 48*a* connected to the portion 45 (in a direct manner or through a duct). The portion 47 can end downstream of the pump 43, namely in the area of the duct (as shown by the continuous line), so that the pumps 43 and 48 are arranged in parallel, or can end upstream of the pump 43 (as shown by the broken line), so that the pumps 43 and 48 are arranged in series along the circuit 41.

According to an aspect of the invention, the heat-exchange fluid circulating in the circuit 41 comprises a phase-change material having a boiling temperature that is such as to cause it to change phase from liquid to vapour when, in use, it flows in the portion 46, namely flows through the expansion section 4, under a given pressure and temperature condition of the engine 2 (in a steady state). At the same time, the cooling circuit 41 is controlled so as to let at least a fraction of the heat-exchange fluid in the portion 46 reach its boiling temperature under the pressure conditions present in the portion 46, unlike what happens in traditional engines, where controls are provided (for example to turn on a fan associated with the radiator) in order to lower the temperature of the cooling liquid before it reaches its boiling temperature.

In particular, the heat-exchange fluid is defined by a mixture of at least two components, one of said components being defined by the aforesaid phase-change material, whereas the remaining part of the heat-exchange fluid is chosen so that a second fraction remains liquid under the temperature and pressure conditions in which the first fluid fraction boils. In other words, this mixture is chosen so as to form an azeotrope.

The remaining liquid fraction of the heat-exchange fluid prevents the cooling channels, in particular areas of the engine (for example, the head), from being full of sole vapour. The presence of a given quantity of liquid in the cooling channels in the engine maintains the heat exchange under ideal conditions.

The phase-change material is preferably defined by ethanol or ethyl alcohol, which boils at a temperature of approximately 150° C. at a pressure of approximately 9.5 bar.

The value of the operating pressure in the circuit 41 is kept at a threshold value by means of a known device, which is not shown herein and is arranged downstream of the portion 46. This threshold value determines the boiling temperature of the heat-exchange fluid in the portion 46.

For example, it is possible to use an azeotrope consisting of ethanol and water, having a percentage that is smaller than 50% and greater than 50%, respectively. In particular, ethanol is used in a percentage ranging from 15% to 20%.

Once the boiling temperature of the azeotrope is reached under the temperature and pressure conditions that were set (for example, a pressure of approximately 150° C. and a pressure of approximately 9.5 bar), a first fraction consisting of a mixture of the two substances (containing approximately 95% of water and 5% of ethanol) starts evaporating. When there is no more ethanol left, the remaining liquid fraction is defined by the sole water (which, at a pressure of 9.5 bar, has a boiling temperature of approximately 177° C., so that, under operating conditions of 150° C., it remains liquid).

According to variants which are not described in detail, an azeotrope with three substances can be used, for example ethanol, water and ethylene glycol.

At the same time, the circuit 41 comprises a vapour turbine, which is indicated with reference number 50 and is arranged downstream of the portion 46 so as to receive the vapour generated in the portion 46 after said vapour has been separated from the liquid fraction by means of a separator 60, as explained more in detail below. The separated vapour expands in the turbine 50 and, as a consequence, produces mechanical energy (which can be extracted in the area of a rotary shaft of the turbine 50), for the recovery of energy. The mechanical energy is preferably turned into electrical energy (by means of a generator, which is not shown, connected to the rotary shaft of the turbine 50).

The circuit 41 further comprises a heat exchanger defining a condenser 54, which has an inlet 55 connected to an outlet 56 of the turbine 50 so as to receive the vapour subjected to the expansion and turn it into liquid (thus transferring heat from said vapour to another fluid, for example ambient air, in a known manner which is not shown herein).

The sizing, during the designing phase, of the condenser 54 is such as to obtain a condensate having a temperature that is as low as possible. For example, the sizing is carried out in such a way that the temperature difference between the condensate and the ambient air (used to cool the vapour flowing out of the turbine 50) is in the range of approximately ten degrees, in order to have an efficient heat exchange. At the same time, the condensation pressure (corresponding to the pressure at the outlet of the turbine 50) must be such as not to cause an exaggerated vacuum in the condenser 54.

Ethanol, which was mentioned above by way of example, at a pressure of approximately 0.5 bar, condenses at approximately 60° C., a temperature that meets the heat exchange needs, even in the presence of ambient temperatures of 40-50° C.

As already mentioned above, ethanol can be replaced by a different phase-change material, which is chosen so as to boil under the desired temperature and pressure conditions and/or under the temperature and pressure conditions set, during the designing phase, for the cooling channels on the inside of the engine 2 (in steady engine state). To this regard, in the cooling channels of the portion 46, a relatively high operating pressure is needed in order to have a good enough pressure drop in the area of the turbine 50 and, hence, a greater mechanical energy extracted from the turbine 50.

The choice of the ideal substance for the phase-change material and for the composition of the azeotrope is made by taking into account its pressure/temperature map and the relative liquid/vapour balances.

Back to FIG. 1, the condenser 54 has an outlet 58, which is connected to a suction port 48*b* of the pump 48. According to a variant, alternatively to or in combination with the connection to the pump 48, the outlet 58 could communicate with a suction port 43*b* of the pump 43 by means of a connection line 59 provided with a properly controlled valve.

The circuit 41 comprises the liquid/vapour separator 60 mentioned above, which has an inlet 61 connected to an outlet of the portion 46, so as to receive the heat-exchange fluid immediately after the latter has removed heat from the head and/or the crankcase of the expansion section 4, and is configured so as to separate the liquid fraction left in the flow flowing out of the portion 46, in order to prevent said liquid fraction from damaging the turbine 50. Hence, the separator 60 has a vapour outlet 63, which is connected to an inlet 64 of the turbine 50, and a liquid fraction outlet 65, which is connected to the inlet 66 of a heat exchanger 67 in order to lower the temperature of said liquid fraction.

The exchanger 67 is preferably sized, during the designing phase, so as to lower the temperature of the liquid fraction by a few degrees, thus maintaining a great temperature difference between said liquid fraction and the ambient air used to cool the radiator 67. In this way, a high efficiency is obtained, which minimizes the energy spent for this cooling and tends to at least partly make up for the energy requested for the cooling in the area of the condenser 54.

The exchanger 67 is defined by a conventional radiator, if the pressure of the circuit is below 2 bar. In this case, using an ethanol and water azeotrope, the maximum temperature in the circuit is controlled so as to reach the boiling temperature of the azeotrope (approximately 98° C., at the set operating temperature of 2 bar) and avoid reaching the boiling temperature (approximately 120° C.) of the remaining liquid fraction (water). If, on the other hand, a greater operating temperature is set, for example in the range of 9.5 bar as suggested above by way of example, the exchanger 67 needs to be capable of resisting this operating pressure, so that a liquid cooling could be necessary, namely a cooling with an "indirect" heat exchange, instead of using a conventional radiator.

The exchanger 67 has an outlet 68, which is connected to the suction mouth 43*b* of the pump 43 in order to reintroduce the liquid fraction in the circulation of the expansion section 4 (together with the fraction that condensed in the condenser 54 and flew through the compression section 3).

Furthermore, one or more valves (for example, pressure limiting valves and/or flow control valves associated with possible bypass branches which are not shown herein) can be arranged along the circuit 41.

The closed-loop configuration comprising the engine 2, the turbine 50, the condenser 54 and the pump 48 allows the circuit 41 to be used as a Rankine cycle. However, according to a variant, it is possible to provide a heating device 80 (shown with a broken line) between the separator and the turbine 50, so as to overheat the vapour fraction fed to the turbine 50, in order to increase the conversion efficiency thereof. The heating device 70 is electrically powered and/or uses the heat of the exhaust gases produced by the engine 2.

Figure 2:
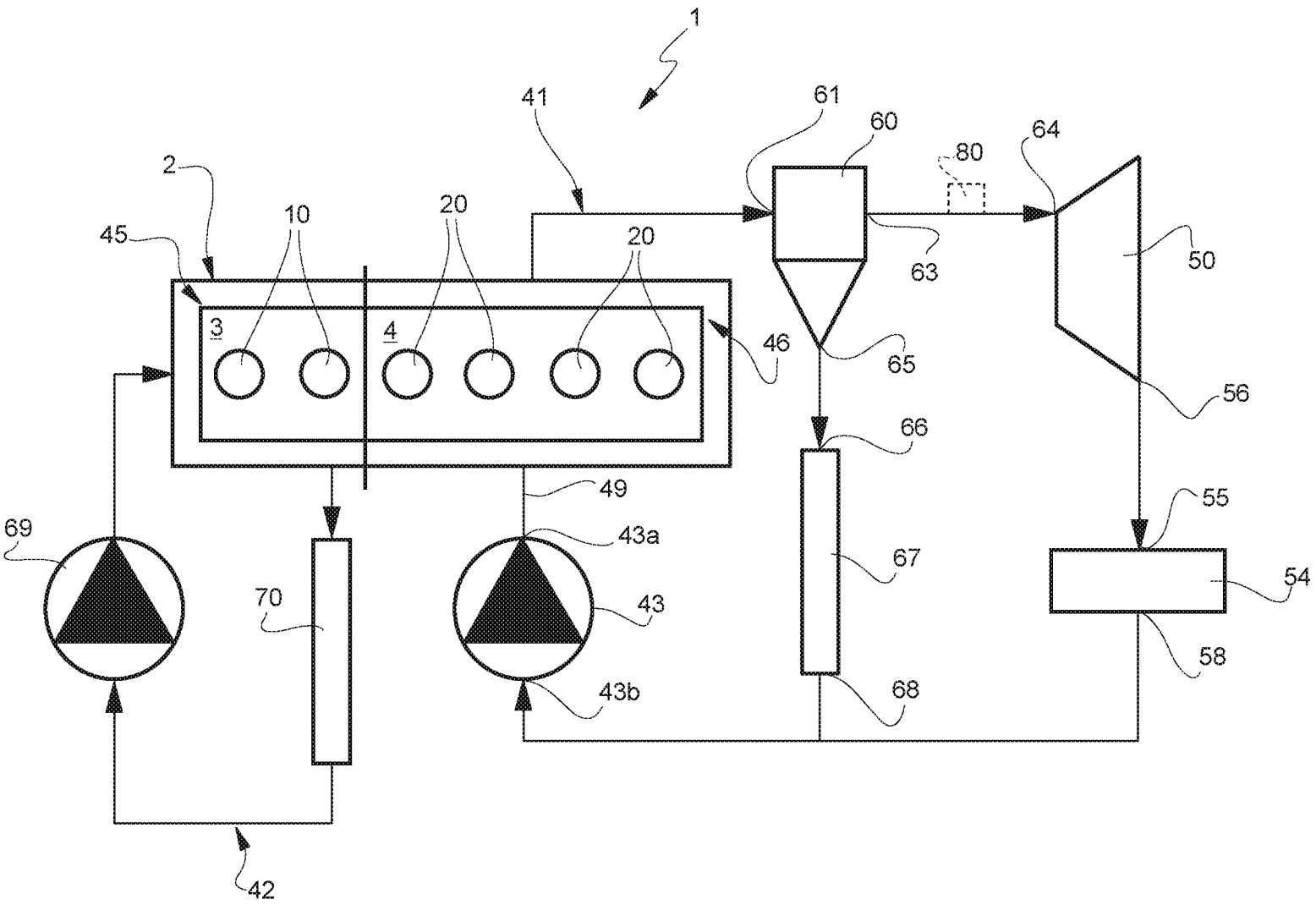
FIG. 2 is similar to FIG. 1 and shows a second embodiment of the engine assembly according to the invention.

In the embodiment of FIG. 2, the circuit 41 is dedicated to the expansion section 4, so that it is not provided with the pump 48 and with the portions 45 and 47; furthermore, the outlet 58 of the condenser 54 is connected to the suction mouth 43*b* of the pump 43, together with the outlet 68 of the exchange 67.

At the same time, there is a cooling circuit 42, which is separate from the circuit 41; the circuit 42 comprises a pump 69, which is distinct from and independent of the pump 43 and conveys a heat-exchange fluid of its own (different from or equal to the substance used in the circuit 41), so that the two fluid cannot be mixed or meet. The circuit 42 extends through the compression section 3 (in the crankcase and/or in the head), so that it is dedicated to removing heat from the crankcase and/or from the head of the compression section 3, and comprises a heat exchanger 70, which is defined, for example, by a conventional radiator. If needed, the exchanger 67 and 70 can be integrated in one single radiator, though keeping the two heat-exchange fluids separate.

Owing to the above, a person skilled in the art clearly understands the advantages of the assembly 1. In particular, the circuit 41 allows energy to be recovered from the heat-exchange fluid in an efficient manner and with a relatively small number of components, exploiting the ability of the phase-change material to turn into vapour inside the engine 2 and to store a large quantity of energy in the form of latent heat in the engine 2 itself.

In the embodiment of FIG. 1, one single mixture flows in the circuit 41 for the cooling, but the flow rates and/or the heat exchanges are different for the two sections 3 and 4 depending on operating conditions, namely based on the actual percentage of fluid turning into vapour while flowing through the engine 2. For example, during the starting phases, the azeotrope has not reached its boiling temperature yet and, therefore, is still in the liquid state and circulates from the separator 60 to the pump 43 together with remaining part of the heat exchange fluid. In this case, the outlet 65 of the separator 60 is preferably connected to the suction port 48*b* by means of the connection line 59, so as to deflect the heat-exchange fluid towards the pump 48, with the control of one or more valves (not shown). On the other hand, under steady state conditions, the azeotrope reaches its boiling temperature in the expansion section 4, so that the vapour flows from the separator 60 to the turbine 50, thus recovering residual heat and turning it into mechanical (and, if necessary, electrical) energy. At the same time, all condensate flows to the compression section 3, where it is pre-heated before being mixed again with the remaining (non-evaporating) part of the heat-exchange fluid.

As mentioned above, the operating temperature should not exceed a predetermined temperature, which is greater than or equal to the boiling temperature of the azeotrope, so as to allow it to evaporate, but smaller than the boiling temperature of the fraction that has to remain liquid. To this aim, there are one or more possible solutions to remove heat, which operate according to known control logics that are not described in detail (for example: an increase in the fluid flow introduced into the expansion section 4, in particular adjusting the pump 43; a deflection of a flow of condensate, which has a relatively low temperature, through the line 59 towards the suction port of the pump 43*b*, if necessary providing an additional tank (not shown) in the area of the line 59; an activation of a fan in the area of the radiator defining the exchanger 67; etc.).

In the configuration of FIG. 2, on the other hand, the two circuits 41 and 42 can be managed in a completely independent manner to set/adjust the heat exchange of the two sections 3 and 4, without them affecting one another.

Furthermore, it is particularly advantageous to use the circuit 41 in a split-cycle engine, due to the relatively high and constant temperatures available in the expansion section 4.

Owing to the above, it is evident that assembly 1 can be subjected to changes and variants, without for this reason going beyond the scope of protection set forth in the appended claims.

In particular, in the solution of FIG. 2, a suitable phase-change material, with a relative vapour turbine, could be used also in the heat-exchange fluid of the compression section 3.

Furthermore, the circulation in the circuit 41 downstream of the condenser 54 and of the exchanger 67 could be different from what discussed above by way of example; and/or there could be bypass branches to avoid having to go through the exchanger 67 and/or the separator in some operating conditions (for example, in engine starting conditions).

The invention claimed is:

1. An engine assembly (1) comprising:

a split-cycle internal combustion engine (2) comprising a compression section (3) and an expansion section (4);

a cooling system comprising a first circuit (41) configured so as to circulate a heat-exchange fluid along at least one closed loop, the first circuit (41) comprising a first pump (43) and a first circuit portion (46) extending through a crankcase and/or a head of at least one of said compression and expansion sections in order to remove heat from said crankcase and/or head;

wherein said heat-exchange fluid has a boiling temperature such that at least a fraction of the heat-exchange fluid changes phase, in use, from liquid to vapour in said first circuit portion (46), in an operating condition of the engine (2); and in that said first circuit (41) comprises a turbine (50) arranged along said closed loop downstream of said first circuit portion (46) in order to receive vapour generated in said first circuit portion (46) and produce mechanical energy by the expansion of the vapour;

wherein said first circuit portion (46) is provided in said expansion section (4);

wherein said cooling system comprises a second circuit (42) which extends through the compression section (3), is separated from said first circuit (41) and comprises a second pump to circulate a further heat-exchange fluid.

2. The engine assembly according to claim 1, characterised in that said first circuit (41) comprises a condenser (54) having an inlet (55) connected with an outlet (56) of the turbine (50).

3. The engine assembly according to claim 1, characterised in that said first circuit (41) comprises a liquid/vapour separator (60) arranged between said first circuit portion (46) and said turbine (50) and configured so as to separate a liquid fraction of said heat-exchange fluid from said vapour.

4. The engine assembly according to claim 3, characterised in that said first circuit (41) comprises a heat-exchanger (67); said liquid/vapour separator (60) having an outlet for the liquid fraction (65) connected to said heat-exchanger (67).

5. The engine assembly according to claim 1, characterised in that said first circuit portion (46) is provided in said expansion section (4).

6. The engine assembly according to claim 1, characterised by comprising a heater (80) between said first circuit portion (46) and said turbine (50) for superheating said vapour.

7. An engine assembly (1) comprising:

a split-cycle internal combustion engine (2) comprising a compression section (3) and an expansion section (4);

a cooling system comprising a first circuit (41) configured so as to circulate a heat-exchange fluid along at least one closed loop, the first circuit (41) comprising a first pump (43) and a first circuit portion (46) extending through a crankcase and/or a head of at least one of said compression and expansion sections in order to remove heat from said crankcase and/or head;

wherein said heat-exchange fluid has a boiling temperature such that at least a fraction of the heat-exchange fluid changes phase, in use, from liquid to vapour in said first circuit portion (46), in an operating condition of the engine (2); and in that said first circuit (41) comprises a turbine (50) arranged along said closed loop downstream of said first circuit portion (46) in order to receive vapour generated in said first circuit portion (46) and produce mechanical energy by the expansion of the vapour;

wherein said first circuit portion (46) is provided in said expansion section (4);

wherein said first circuit (41) comprises:

a second circuit portion (45) extending through said compression section (3);

a third pump (48) distinct from said first pump (43), adapted to cause condensate, obtained downstream of the turbine (50), to flow in said second circuit portion (45).

8. The engine assembly according to claim 7, characterised in that said first circuit (41) comprises:

a heat-exchanger (67);

a liquid/vapour separator (60) having an outlet for a liquid fraction (65) connected to said heat-exchanger (67) and an outlet for the vapour (63) connected to an inlet of said turbine (50); and a condenser (54) connected to an outlet of said turbine (50) for obtaining said condensate; said first and third pumps (43, 48) having respective suction mouths connected, respectively, to an outlet of said heat-exchanger and to an outlet of said condenser (54); said first circuit (41) comprising a connection portion (47) which sets an outlet of said second circuit portion (45) in communication with an inlet of said first circuit portion (46).

9. The engine assembly according to claim 8, characterised in that said first circuit (41) comprises communication means (59) which are controlled in order to divert a flow of condensate toward said first pump and/or to divert a flow of liquid fraction towards said third pump in given operating conditions.

10. The engine assembly according to claim 7, characterised in that said first circuit (41) comprises a condenser (54) having an inlet (55) connected with an outlet (56) of the turbine (50).

11. The engine assembly according to claim 7, characterised in that said first circuit (41) comprises a liquid/vapour separator (60) arranged between said first circuit portion (46) and said turbine (50) and configured so as to separate a liquid fraction of said heat-exchange fluid from said vapour.

12. The engine assembly according to claim 11, characterised in that said first circuit (41) comprises a heat-exchanger (67); said liquid/vapour separator (60) having an outlet for the liquid fraction (65) connected to said heat-exchanger (67).

13. The engine assembly according to claim 7, characterised in that said first circuit portion (46) is provided in said expansion section (4).

14. The engine assembly according to claim 7, characterised by comprising a heater (80) between said first circuit portion (46) and said turbine (50) for superheating said vapour.

* * * * *